US008660450B2

(12) United States Patent
Furuyama

(10) Patent No.: US 8,660,450 B2
(45) Date of Patent: Feb. 25, 2014

(54) FIXING DEVICE

(75) Inventor: Noboru Furuyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 280 days.

(21) Appl. No.: 13/161,682

(22) Filed: Jun. 16, 2011

(65) Prior Publication Data

US 2011/0311256 A1 Dec. 22, 2011

Related U.S. Application Data

(60) Provisional application No. 61/355,820, filed on Jun. 17, 2010.

(51) Int. Cl.
*G03G 15/20* (2006.01)

(52) U.S. Cl.
USPC ..... 399/70; 399/68; 399/69

(58) Field of Classification Search
USPC ..... 399/69, 68
See application file for complete search history.

(56) References Cited

U.S. PATENT DOCUMENTS

| | | | | |
|---|---|---|---|---|
| 7,949,274 | B2 | 5/2011 | Furuyama | |
| 2008/0069582 | A1 * | 3/2008 | Yamada et al. | 399/70 |
| 2010/0303496 | A1 * | 12/2010 | Mukai | 399/70 |
| 2011/0188875 | A1 | 8/2011 | Nakayama | |

* cited by examiner

*Primary Examiner* — Walter L Lindsay, Jr.
*Assistant Examiner* — Roy Y Yi
(74) *Attorney, Agent, or Firm* — Turocy & Watson, LLP

(57) ABSTRACT

In a fixing device for electrophotography, a fixing sheet carrying thereon a toner image is passed under application of heat and pressure between a toner heating member and a press roller to fix the toner image onto the a fixing sheet. The fixing device is so controlled that a temperature of the toner heating member is set higher and a temperature of the press roller is set lower in a ready-display state during warm-up for starting the fixing device or returning from a power save mode, respectively compared with corresponding set temperatures of the toner heating member and the press roller in a normal ready state. As a result, consumption of fixing energy is suppressed and the time until the ready state is reduced by a relatively simple control.

11 Claims, 6 Drawing Sheets

FIXING DEVICE

CROSS-REFERENCE TO RELATED APPLICATION

This application is based upon and claims the benefit of priority from: U.S. provisional application 61/355,820, filed on Jun. 17, 2010, the entire contents of which are incorporated herein by reference.

FIELD

Embodiments described herein relate generally to a fixing device that fixes a formed toner image under heat and pressure onto a fixing sheet, such as a sheet of paper, in an electrophotographic type of image forming apparatus, such as a copier, a printer, a facsimile machine, and the like.

BACKGROUND

In electrophotography, an electric latent image is formed on an image carrier and is developed by toner to form a toner image, which is then transferred onto a fixing sheet, such as a sheet of paper, and is then fixed by means of heating and pressing, etc. For the toner to be used for forming images, not only conventional monochromatic black toner, but also multiple-colored toners for forming full-color images, are used to form the images. The toner image transferred onto the fixing sheet is fixed on the fixing sheet under heating and pressing while passing between a toner-heating member, such as a heat roller or a heat belt, and a press roller functioning as an oppositely disposed pressure-support member, and is discharged together with the fixing sheet out of the image forming apparatus.

Recently, in response to demand for a higher speed operation of electrophotographic image forming apparatus, there arise a demand for a further speed increase in a fixing device included in the image forming apparatus and a demand for reducing the time taken to reach a printable state (ready state) from power switch-ON for starting or switch-ON in a low-power consumption (power-saving) mode (that is, preheating mode or sleep mode). On the other hand, in the fixing device that occupies a substantial portion of the energy consumed by the electrophotographic image forming apparatus, there is a demand for suppressing the total energy consumption and achieving the speed increase in combination.

Further, although it has been conventional to supply heating energy to the toner image form only a toner heating member, it has become a recent practice to supply heating energy to a press roller, in addition to the toner heating member, in accordance with demand for higher speeds and an increasing demand for full-color image formation which requires increased thickness of the toner layer on the fixing sheet. In these circumstances, particularly, in order to achieve both suppression of energy consumption and reduction in the time taken to reach a ready state for the fixing device, there have been proposed a fixing device including a control unit that variably controls the power supply to a toner heating member, such as a heat roller, and a press roller (JP-A-2008-268957), and a fixing device including a control unit that variably controls the pre-run speed of a toner heating member and a press roller (JP-A-2009-301028). Although the fixing devices are advantageous in achieving the objects described above, the fixing devices have a drawback that the control units are complicated.

DETAILED DESCRIPTION

In the present invention, reduction of the time that is taken to reach a ready state is achieved by suppressing energy consumption and using a control unit having a relatively simple structure.

An embodiment of the present invention provides a fixing device for electrophotography, wherein a fixing sheet carrying thereon a toner image is passed under application of heat and pressure between a toner heating member and a press roller to fix the toner image onto the a fixing sheet; the fixing device including: a control unit that sets a temperature of the toner heating member and a temperature of the press roller in a normal ready state, and also sets a higher temperature of the heating member and a lower temperature of the press roller for a ready-display state during warm-up for starting the fixing device or returning from a power save mode. In the fixing device having this configuration, the "normal ready state" refers to a pause period during normal printing, which is a "printable state" where printing immediately starts when an operator has pressed a print button. On the other hand, "warm-up" refers to at least one of transition periods after pressing a print button of from a "state when main power of the image forming apparatus is cut" to the "printable state" and of switching from a low power state ("preheating mode" or "sleep mode") that suppresses power supply to the toner heating member (or press roller) to the "printable state" from the viewpoint of saving power when the "printable state" has continued for a predetermined time or longer.

Of the objects described above, only form the object of reducing the time of transition to the ready state (printable state) regardless of the starting and the returning from the low power mode, it is effective to increase the energy supply to the press roller, thereby preventing delay in reaching the ready state temperature of the press roller, compared with the toner heating member. However, the increase in the ratio of heat supply to the press roller through the fixing sheet, with respect to the total amount of supplied heat for heating and press-fixing, is not preferable from the viewpoint of effectively using the amount of heat for fixing. Therefore, a preferred embodiment of the present invention adopts a scheme of using the toner heating member as a main supplier of the heat for fixing, while heat supply to the press roller is made only supplementary, if any, and reducing the total time until the ready state by decreasing the delay in increase of temperature of the press roller relative to the toner heating member in the warm-up or the switching to the ready state-display temperature.

A preferred embodiment of the fixing device of the present invention is described hereinbelow with reference to the accompanying drawings.

Figure 1:
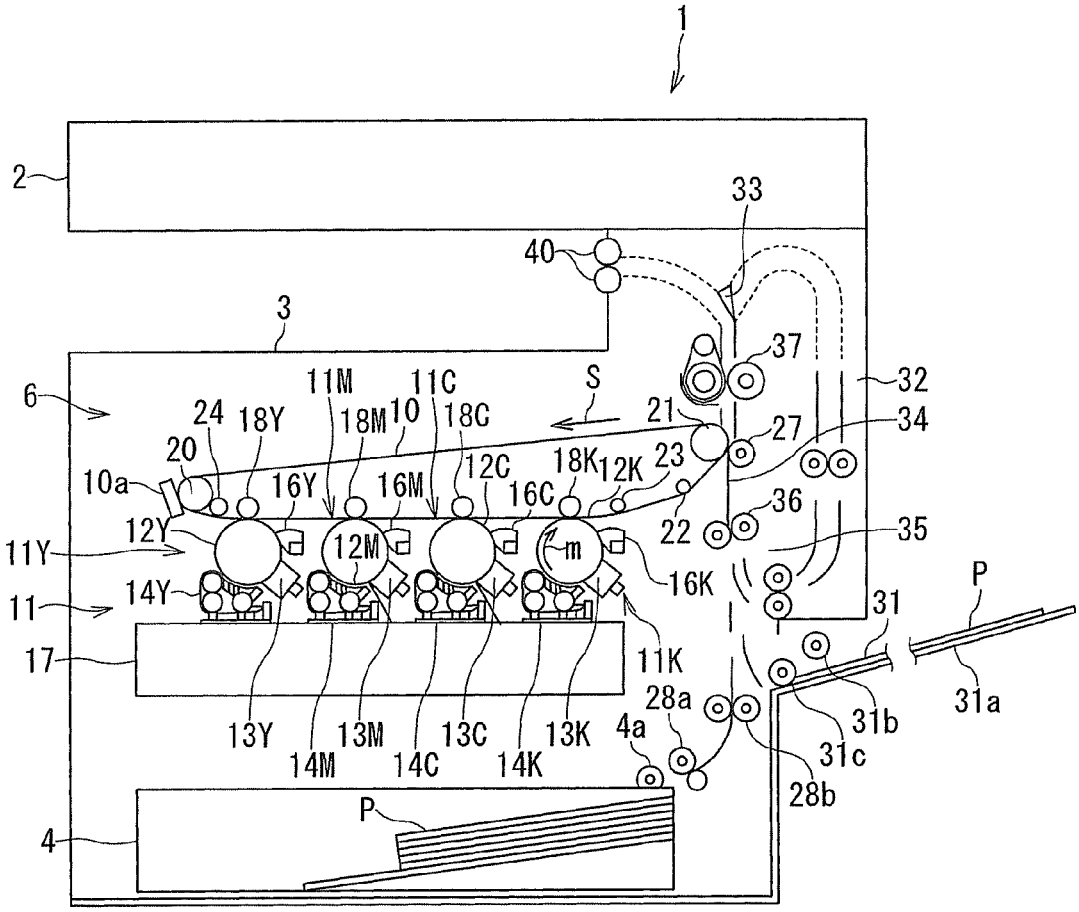
FIG. 1 is an illustration schematically showing the configuration of an image forming apparatus equipped with a fixing device according to an embodiment of the present invention.

FIG. 1 shows a 4-series tandem type of color image forming apparatus 1 equipped with a fixing device 37 of the embodiment. The color image forming apparatus 1 includes a scanner unit 2, a paper discharge unit 3, and a printer unit 6. The printer unit 6 includes an image forming unit 11 provided with four image forming stations 11Y, 11M, 11C, and 11K of yellow (Y), magenta (M), cyan (C), and black (K), which are arranged in parallel downstream of an intermediate transfer belt 10.

The image forming stations 11Y, 11M, 11C, and 11K include photoconductive drums 12Y, 12M, 12C, and 12K, respectively. Chargers 13Y, 13M, 13C, and 13K, developing devices 14Y, 14M, 14C, and 14K, and photoconductive drum cleaning devices 16Y, 16M, 16C, and 16K are arranged in the rotation direction indicated by a solid arrow m, around the photoconductive drums 12Y, 12M, 12C, and 12K, respectively. Light is irradiated by a laser exposure device 17 between the chargers 13Y, 13M, 13C, and 13K and the developing devices 14Y, 14M, 14C, and 14K around the photoconductive drums 12Y, 12M, 12C, and 12K, respectively. Electrostatic latent images are formed on the photoconductive drums 12Y, 12M, 12C, and 12K when the light is irradiated.

The developing devices 14Y, 14M, 14C, and 14K each have a two-component developer composed of toner and carrier for yellow (Y), magenta (M), cyan (C), and black (K). The developing devices 14Y, 14M, 14C, and 14K supply toner onto the electrostatic latent images on the photoconductive drums 12Y, 12M, 12C, and 12K, respectively.

The intermediate transfer belt 10 is held by a backup roller 21, a driven roller 20, and first to third tension rollers 22 to 24. The intermediate transfer belt 10 is in contact with the photoconductive drums 12Y, 12M, 12C, and 12K. Primary transfer rollers 18Y, 18M, 18C, and 18K are disposed where the intermediate transfer belt 10 is in contact with the photoconductive drums 12Y, 12M, 12C, and 12K, in order to primarily transfer the toner image that is the image formed on the photoconductive drums 12Y, 12M, 12C, and 12K onto the intermediate transfer belt 10.

A secondary transfer roller 27 is disposed at a secondary transfer section of the intermediate transfer belt 10. A predetermined secondary transfer bias is applied to the backup roller 21, in the secondary transfer portion. A paper feed cassette 4 that supplies a sheet P toward the secondary transfer roller 27 is disposed under the laser exposure device 17. A manual mechanism 31 for supplying the sheet P by hand is disposed at the right side of the color image forming apparatus 1.

A pickup roller 4*a*, a separating roller 28*a*, a conveying roller 28*b*, and a resist roller 36 are disposed between the paper feed cassette 4 and the secondary transfer roller 27. A manual pickup roller 31*b* and a manual separating roller 31*c* are disposed between a manual tray 31*a* of the manual mechanism 31 and the resist roller 36.

On the sheet P, the toner image on the intermediate transfer belt 10 is secondarily transferred while the sheet P is interposed between the intermediate transfer belt 10 and the secondary transfer roller 27 and conveyed. After the secondary transferring, the intermediate transfer belt 10 is cleaned by a belt cleaner 10*a*. The fixing device 37 is disposed downstream of the secondary transfer roller 27 in the movement direction of the sheet P. The sheet P that is taken out of the paper feed cassette 4 or supplied from the manual mechanism 31 is conveyed to the fixing device 37 along a longitudinal conveying path 34 through the resist roller 36 and the secondary transfer roller 27.

A gate 33 is disposed downstream of the fixing device 37 and performs distribution toward a paper discharge roller 40 and a re-conveying unit 32. The sheet sent to the paper discharge roller 40 is discharged to the paper discharge unit 3. The sheet sent to the re-conveying unit 32 is sent back toward the secondary transfer roller 27.

Figure 2:
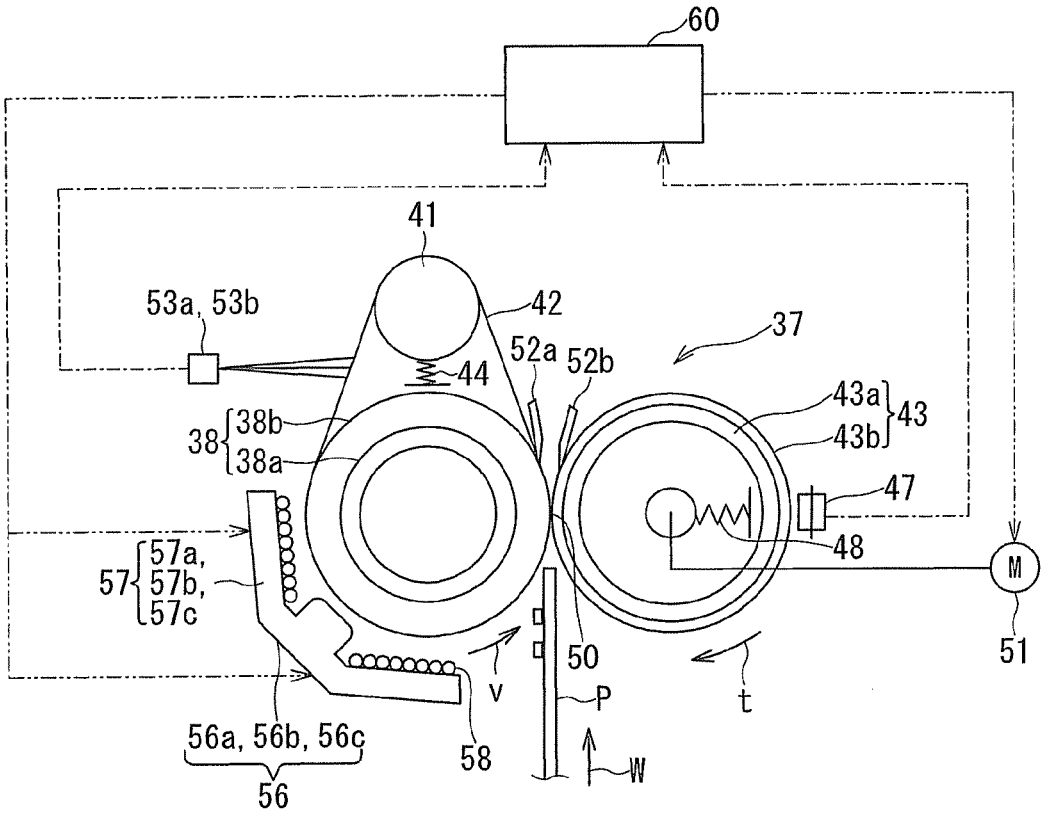
FIG. 2 is an illustration schematically showing the configuration of the fixing device, as viewed laterally.
Figure 3:
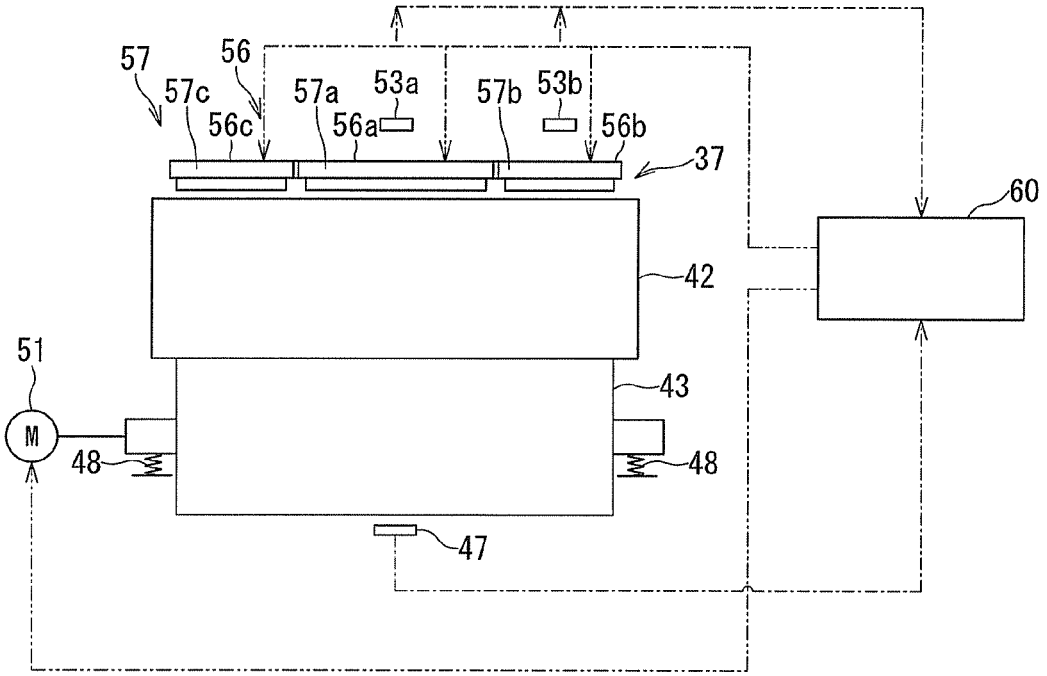
FIG. 3 is an illustration schematically showing the configuration of the fixing device, as viewed from the above.

Next, the fixing device 37 will be described. FIG. 2 is a view schematically showing the configuration of the fixing device 37, seen from a side. FIG. 3 is a view schematically showing the configuration of the fixing device 37, seen from above. The fixing device 37 includes a heat belt 42 that is an endless belt member held on a fixing roller 38 and a tension roller 41, and a press roller 43 that is a nip forming member. The fixing roller 38 is formed by, e.g., forming a foamed rubber (sponge) coating layer 38*b* having a thickness of 8.5 mm on a core metal 38*a* having a thickness of 2 mm. The outer diameter of the fixing roller 38 is 48.5 mm, for example. The outer diameter of the tension roller 41 is 17 mm, for example. The tension roller 41 is formed by, for example, coating the surface of a metal pipe made of aluminum (Al). The material of the metal pipe may be iron, copper, and stainless steel, or the like. Further, a heat pipe having a greater thermal conduction rate may be used, instead of the metal pipe.

Figure 4:
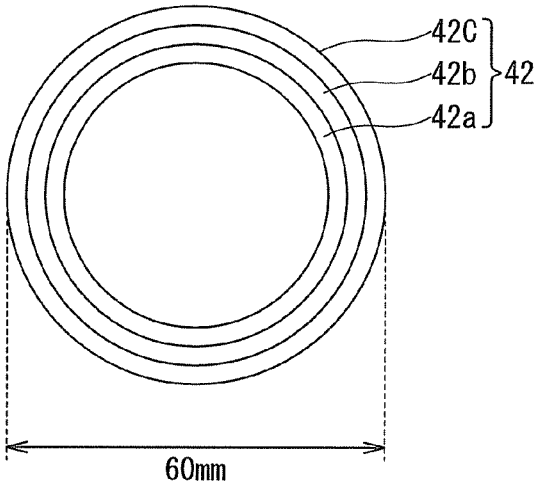
FIG. 4 is an illustration schematically showing the structure of a heat belt according to the embodiment.

The heat belt 42, as shown in FIG. 4, is formed by sequentially stacking a solid rubber layer 42*b* made of silicon rubber having a thickness of 200 μm and a mold-releasing layer 42*c* formed of a PFA tube having a thickness of 30 μm on a metal layer, for example, a metallic conductive layer 42*a* made of nickel (Ni) in a thickness of 40 μm. The heat belt 42 has an outer diameter of 60 mm, for example, when having a cylindrical shape. The heat belt 42 is extended between the fixing roller 38 and the tension roller 41, by a predetermined tension by a tension mechanism 44.

A first temperature sensor 53*a* that is a first sensor that detects the temperature of the center portion of the heat belt and a second temperature sensor 53*b* that detects the temperature of the side portion of the heat belt are arranged around the heat belt 42. For example, a thermopile-type sensor that detects infrared ray without contact is used as the first and second temperature sensors 53*a* and 53*b*. The temperature distribution in the width direction of the heat belt 42 is controlled by the first temperature sensor 53*a* and the second temperature sensor 53*b*. The sensors detecting the temperature of the heat belt 42 are not limited to two. The temperature distribution in the width direction may be controlled by disposing three temperature sensors and measuring the center portion and both side portions of the heat belt 42.

The press roller 43 is formed by, for example, coating a rubber layer 43*b* around a cored bar 43*a*. The outer diameter of the press roller 43 is 50 mm, for example. Silicon rubber or fluorine rubber and the like is used for the rubber layer. A roller temperature sensor 47 that is a second sensor is disposed around the press roller 43. The press roller 43 is in pressing contact with the fixing roller 38 and the heat belt 42 by a pressing mechanism 48. A nip portion 50 having a predetermined width is formed between the heat belt 42 and the press roller 43 by the pressing contact of the press roller 43. The pressing mechanism 48 can control the pressing force, such that the pressing mechanism reduces, for example, with respect to the pressing force during warming-up and fixing of the fixing device 37, the pressing force in a ready mode and preheating.

The press roller 43 is rotated in the direction indicated by a solid arrow t by a driving motor 51 that is a driving member. The fixing roller 38, tension roller 41, and heat belt 42 are rotated in the direction indicated by a solid arrow v by the press roller 43. The driving motor 51 can control a driving speed. The driving motor 51 drives the press roller 43 at 270 mm/sec, for example, in the fixing of the fixing device 37 and the warming-up. The driving motor 51 drives the press roller 43 at 90 mm/sec, for example, in the ready mode of the fixing device 37 and the preheating. The driving motor 51 changes the speed of driving the press roller 43, depending on the status of temperature of the fixing device 37, for example, when returning from the sleep mode.

The fixing device 37 fuses, presses, and bonds toner onto the sheet P and fixes a toner image on the sheet P, by passing the sheet P conveyed in the direction indicated by a solid arrow w through the nip portion 50 between the heat belt 42 and the press roller 43. The fixing device 37 includes, at the outlet for the sheet P, a separating blade 52*a* that separates the sheet P from the heat belt 42 and a separating blade 52*b* that separates the sheet P from the press roller 43.

The fixing device 37 includes an electromagnetic induction coil 56 (hereafter, referred to as an IH coil) that is a belt heating member and a member generating an induction current, on the outer circumference of the heat belt 42. The IH coil 56 is composed of a first IH coil 56*a* that heats the center portion of the heat belt 42, and a second IH coil 56*b* and a third IH coil 56*c* that heat both side portions of the heat belt 42. The second and third IH coils 56*b* and 56*c* are connected in series and simultaneously controlled to drive. The first IH coil 56*a* and the second and third IH coils 56*b* and 56*c* are selectively switched and driven. All the coils are set to be able to output from 200 W to 1500 W, for example.

The IH coils 56*a* to 56*c* are formed by winding an electric wire 58 on magnetic cores 57*a* to 57*c*, respectively. As the electric wire 58, for example, a litz wire formed by bundling up sixteen wires of copper material coated with heat resistant polyamideimide and having a thickness of 0.5 mm is used. It is possible to make the diameter of the electric wire 58 smaller than a penetration amount of magnetic field by using the litz wire as the electric wire 58. Therefore, it is possible to effectively apply high-frequency current to the electric wire 58. When a predetermined high-frequency current is applied to the electric wire 58, the first to third IH coils 56*a* to 56*c* generate a predetermined magnetic flux. An eddy-current is generated in the metallic conductive layer 42*a* by the magnetic flux to interfere with changes in magnetic field. Joule heat is generated by resistance values of the eddy-current and the metallic conductive layer 42*a*, such that the heat belt 42 is instantly heated. The high-frequency current flowing in the IH coils 56*a* to 56*c* is in the range of 20 kHz to 100 kHz, for example.

Since the IH coils 56*a* to 56*c* use the magnetic cores 57*a* to 57*c*, the magnetic flux density of the IH coils 56*a* to 56*c* can be increased. Since the magnetic cores 57*a* to 57*c* are used, the number of windings of the electric wire 58 can be reduced. As shown in FIG. 2, the heat belt 42 is intensively heated by making the cross-sections of the magnetic cores 57*a* to 57*c* in roof shapes such that the magnetic flux of the IH coils 56*a* to 56*c* are locally concentrated.

A control unit 60 (actually, as a part of a control unit including other devices, such as the developing device, transfer device, and pausing device of the image forming apparatus 1) is disposed in the fixing device 37. The control unit 60 controls the output of the IH coils 56*a* to 56*c* for heating the heat belt and the rotation speed of the driving motor 51 of the press roller 43, on the basis of the outputs of the temperature sensors 53*a* and 53*b* of the heat belt.

Next, temperature profiles (change with time) of the heat belt 42 and the press roller 43 during the warm-up according to the related art and the embodiment will be described first with reference to FIG. 5. When a warm-up mode is started at an initial temperature of, e.g., 25° C. at a time point OST by turning on power supply, the heat belt 42 is start to be heated, and simultaneously therewith, pre-run of the press roller 43 and the heat belt 42 is started by the motor 51. When the temperature of the heat belt 42 reaches the ready state temperature of approximately 150° C., pre-run of the heat belt 42 and the press roller 43 is continued while the heated state of the heat belt 42 is controlled so as to maintain the temperature, and when the temperature of the press roller 43 reaches the ready state temperature of approximately 120° C., the ready state is indicated and the pre-run is stopped, whereby a printing order by pressing the print button is awaited (or reserved printing is started). During the printing, the power supplied to the IH electric wire 58 is controlled so as to maintain the temperature of the heat belt 42 at the ready state temperature; however, if the amount of heat supplied to the toner image for fixing is increased and the temperature of the heat belt 42 decreases to approximately 135° C., the printing is momentarily paused (i.e., placed in a print-pause state) until the ready state temperature is resumed (indicated by a PR curve). When a state of receiving no request for printing continues for a predetermined time or longer (for example, approximately 5 minutes), the system including the fixing device is shifted to a preheating mode of approximately 70° C. as the temperature of the press roller and, when the state of receiving no request for printing continues for a predetermined time or longer (for example, approximately 10 minutes, in total), the system is shifted to the sleep mode in which the temperature of the fixing device is not usually controlled.

Figure 5:
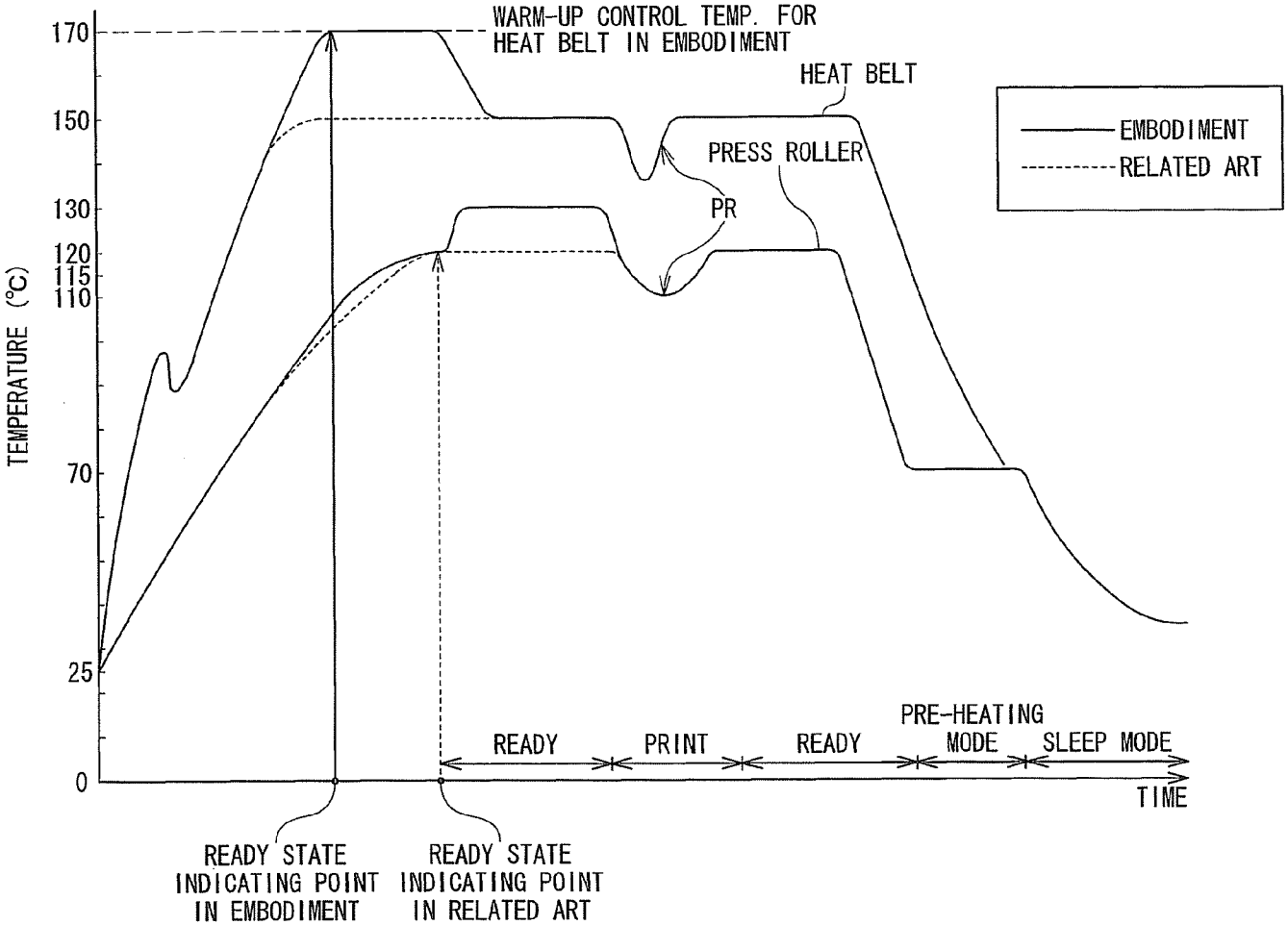
FIG. 5 is a graph showing temperature profiles (time change) of heat belts and press rollers according to the related art and the embodiment.

Next, a start-up mode according an embodiment is described first with respect to a related art also with reference to FIG. 5. At a starting time point OST at an initial temperature of 25° C., when power supply is on, the heat belt 42 is started to be heated by supplying a current to the IH heater wires 58, and simultaneously therewith, the pre-run of the press roller 43 and the heat belt 42 is started by the motor 51, similarly as in the related art. Thereafter, however, as indicated by solid lines (in contrast with dotted lines representing the related art) in FIG. 5, the temperature of the heat belt 42 is set to be controlled at a temperature of, e.g., about 170° C. which is higher by 10-25° C. than a normal ready state temperature of, e.g., about 150° C., while a ready state-indicating temperature of the press roller is set to about 110° C. which is lower by 10-25° C. than a normal ready state temperature. Accordingly, the controlled heating of the heat belt 42 is continued up to 170° C. and so as to retain the temperature while continuing the pre-run of the heat belt 42 and the press roller 43. Then, when the temperature of the press roller 43 has reached the ready state-indicating temperature, a ready state is indicated, and then the press roller 43 is continually heated up to 120° C. which is sufficient for printing, so that the set control temperature of the heat belt 42 is lowered to a normal ready temperature of about 150° C. Then, the heat belt temperature is maintained and the press roller is heated up to a normal ready temperature of about 130° C., whereby and a printing order by pressing the print button is awaited.

Figure 6:
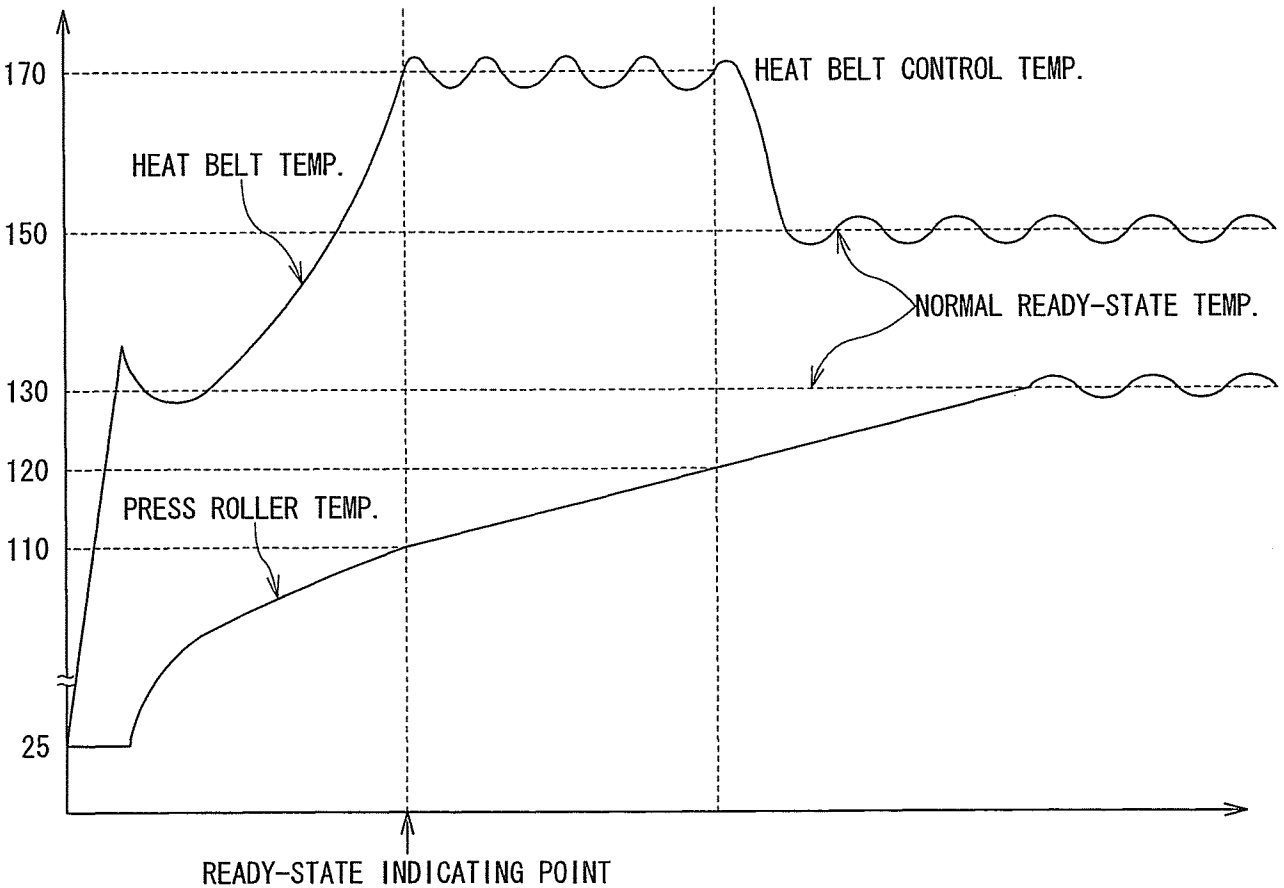
FIG. 6 is a partial enlargement of FIG. 5 illustrating the portion from the start of the warm-up to the ready state.
Figure 7:
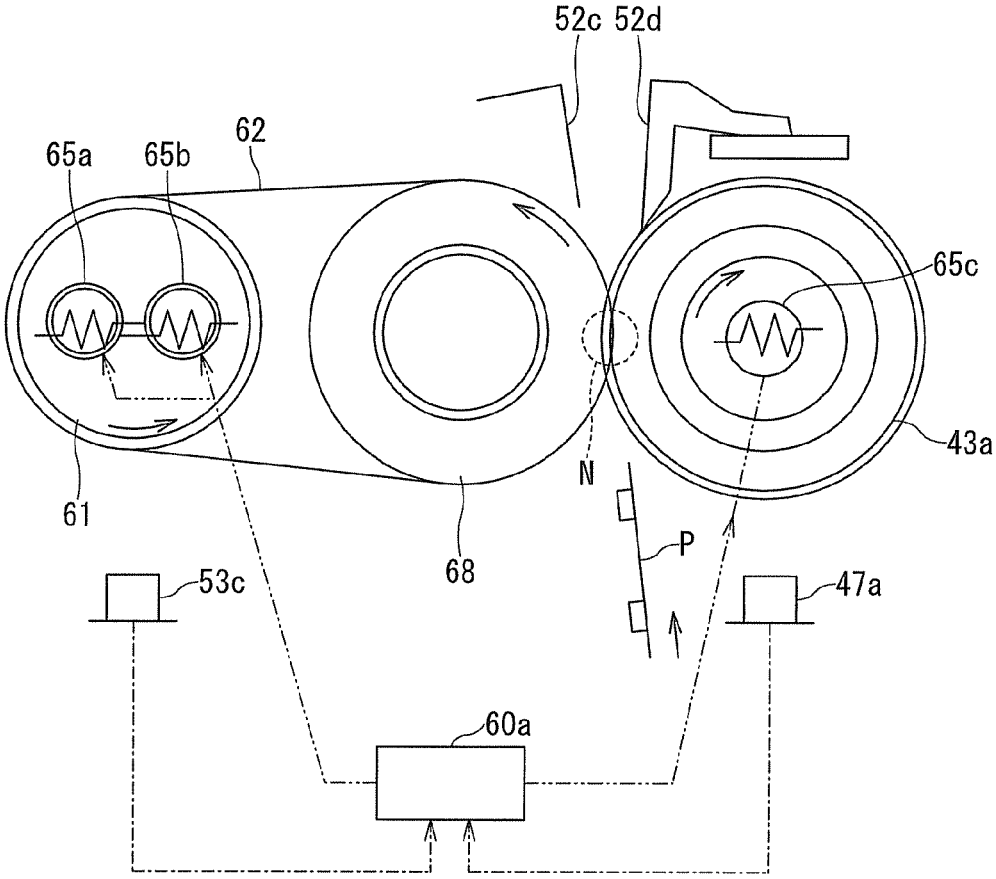
FIG. 7 is an illustration schematically showing the configuration of a fixing device according to another embodiment, as viewed laterally.

FIG. 6 is a partial enlargement view of FIG. 5 until the ready state described so far of the embodiment.

As another embodiment, an intermediate step of setting the heat belt 42 temperature to about 165° C., when the press roller 43 temperature has reached about 115° C., may be placed so as to allow a smoother transition to the normal ready state in the above-described embodiment.

Incidentally, in case where the heat belt 42 temperature is lowered according to environmental change or for some other reason, before the press roller temperature reaches 120° C., the system is placed in a waiting state, which may be set to enter when the heat belt 42 temperature is lowered to a temperature of, e.g., about 140° C., which is lower by 20-40° C. than the set control temperature of, e.g., about 170° C. of the heat belt temperature.

The operation and control during the printing, the print-pause or standby state, and the transition to the preheating and the sleep mode, are essentially identical to those in the related art. As a result, as shown at the lower part in FIG. 5, the warm-up time is reduced in the embodiment represented by a solid line compared with the related art represented by a dotted line.

Similar warm-up operation and control are performed as in the above-described also for recovery from a low-power consumption mode (i.e., preheating or sleep mode), except the starting temperature of the heat belt is higher than the temperature at the time point OST shown in FIG. 5 of approximately 25° C.

(Modified Embodiments)

In the above, a preferred embodiment of the fixing device of the present invention has been described in detail with reference to FIG. 1 to FIG. 5. However, it would be easily understood by those skilled in the art that the embodiment may be modified in various ways within the scope of the present invention. The following are some examples of such modification.

1) Although it seems not necessary to be particularly touched upon, the temperature profile shown in FIG. 5 is merely an example to aid understanding of the embodiment of the present invention compared with the related art, and specific values of the set temperatures in respective states and the temperature differences between the states can be significantly changed in accordance with the thermal capacity of each fixing device member and the thermal characteristic of the used toner. For example, the set temperature of the heat belt (toner heating member) in a normal ready state may generally be within the range of 120 to 160° C., and the set temperature of the press roller may be set to a temperature that is lower by 10 to 60° C. than the set temperature of the heat belt.

2) As for the members of the fixing device, it is possible to dispose a halogen lamp, e.g., inside the press roller 43 shown in FIG. 2 for supplementarily heating the press roller 43 to supply a lower amount of heat than (e.g., ½ of) the amount of heat supplied from the IH heaters 56 to 58. As a result, the warm-up time can be further reduced and it is possible to more precisely control the temperature of the press roller in the ready state by controlling such an internal heater by using the control unit 60.

3) In the embodiment described above, the heat belt 42 held on the fixing roller 38 is used as the toner heating member. However, the fixing roller 38 itself can be used as a toner heating member or a toner heating and fixing member that can supply heat by using an IH heater or a internal halogen lamp.

4) Although it is similar to the example shown in FIG. 2, as correspondingly shown in FIG. 6, the fixing device can also be composed of a fixing roller 68 that has an identical configuration as the fixing roller 38, a heat belt 62 formed of a rubber belt that is held on a heat roller 61 having, e.g., internal halogen lamps 65 and 65*b* as heating sources, and coated with, e.g., a silicon rubber layer having good releasability, and a press roller 43*a*, e.g., having an internal halogen lamp 65*c* such that a control unit 60*a* receives outputs of a temperature sensor 53*c* detecting the surface temperature of the belt 62 and a temperature sensor 47*a* detecting the surface temperature of the press roller 43*a* and controls the power supplied to the halogen lamps 65*a* to 65*c*.

What is claimed is:

1. In a fixing device for electrophotography, wherein a fixing sheet carrying thereon a toner image is passed under application of heat and pressure between a toner heating member and a press roller to fix the toner image onto the a fixing sheet, the fixing device includes:

a control unit that sets a temperature of the toner heating member and a temperature of the press roller in a normal ready state, and also sets a higher temperature of the heating member and a lower temperature of the press roller for a ready-display state during warm-up for starting the fixing device or returning from a power save mode, and gradually reduces the set temperature of the toner heating member in accordance with increase in temperature of the press roller during the warm-up.

2. The device according to claim 1, wherein the toner heating member is a heat belt that is induction-heated and the press roller is heated only by heat conduction from the heat belt.

3. The device according to claim 1, wherein the toner heating member is a heat belt that is induction-heated and the press roller is heated by an internal heat source, in addition to heat conduction from the heat belt.

4. The device according to claim 1, wherein the toner heating member is a heat belt that is held on and heated by a heat roller equipped with an internal heat source, and the press roller is heated only by heat conduction from the heat belt.

5. The device according to claim 1, wherein the toner heating member is a heat belt that is held on and heated by a heat roller equipped with an internal heat source, and the press roller is heated by an internal heat source, in addition to heat conduction from the heat belt.

6. , A fixing device for electrophotography, wherein a fixing sheet carrying thereon a toner image is passed under application of heat and pressure between a toner heating member and a press roller to fix the toner image onto the a fixing sheet, the fixing device includes:

a control unit that sets a temperature of the toner heating member and a temperature of the press roller in a normal ready state, and also sets a higher temperature of the heating member and a lower temperature of the press roller for a ready-display state during warm-up for starting the fixing device or returning from a power save mode, wherein the set temperature of the toner heating member in the normal ready state is in a range of 120° C. to 160° C. and the set temperature of the press roller is set within a temperature range that is lower by 10° C. to 60° C. than the set temperature of the toner heating member, respectively in the normal state.

7. A fixing device, comprising:

a toner-heating member heating a fixing member carrying a toner image thereon, a press member disposed opposite to the press member, and a control unit that controls to heat the toner-heating member to a first temperature and heat the press member to a second temperature, thereby forming a ready state, thereafter raise the temperature of the press member to a third temperature which is higher than the second temperature, and control the temperature of the toner-heating member to a temperature between the first temperature and a fourth temperature which is lower than the first temperature in accordance with the raise of the temperature of the press member.

8. The device according to claim 7, wherein the control unit controls to place a wait state wherein a fixing operation is stopped when the temperature of the toner-heating member is lowered below the first temperature before the press member reaches the third temperature after the press member has reached the second temperature.

9. The device according to claim 7, wherein the control unit controls to lower the first temperature of the toner-heating member to the fourth temperature lower than the first temperature after the press member has reached the third temperature.

10. The device according to claim 7, wherein the control unit controls to keep the fourth temperature of the toner-heating member after the press member has reached the third temperature.

11. The device according to claim 7, wherein the control unit controls to heat the temperature of the press member to a fifth first temperature higher than the third temperature after the press member has reached the third temperature.

* * * * *